US008365336B2

(12) United States Patent
Morris

(10) Patent No.: US 8,365,336 B2
(45) Date of Patent: Feb. 5, 2013

(54) ROTATABLE SAW BLADE FOR ROUTING THROUGH A SEWER LINE

(76) Inventor: Anthony C. Morris, Oak Ridge, TN (US)

( * ) Notice: Subject to any disclaimer, the term of this patent is extended or adjusted under 35 U.S.C. 154(b) by 784 days.

(21) Appl. No.: 12/386,559

(22) Filed: Apr. 20, 2009

(65) Prior Publication Data

US 2010/0263144 A1 Oct. 21, 2010

(51) Int. Cl.
*B08B 1/00* (2006.01)

(52) U.S. Cl. ..... 15/104.31; 15/104.09; 15/104.12

(58) Field of Classification Search ..... 15/104.09, 15/104.12, 104.31
See application file for complete search history.

(56) References Cited

U.S. PATENT DOCUMENTS 3,109,464 A * 11/1963 La Force ..... 83/852
3,740,785 A * 6/1973 Latall ..... 15/104.12
4,292,871 A * 10/1981 Neumeyer et al. ..... 83/661
4,630,676 A * 12/1986 Long, Jr. ..... 166/55
4,773,115 A * 9/1988 Smith ..... 15/104.12
2010/0322733 A1 * 12/2010 Allen et al. ..... 408/231

* cited by examiner

*Primary Examiner* — Lee D Wilson
*Assistant Examiner* — Shantese McDonald
(74) *Attorney, Agent, or Firm* — Michael E. McKee

(57) ABSTRACT

A rotatable root saw blade for routing through a sewer line for purposes of cutting debris or roots from the interior wall of the sewer line includes a body having an arcuate portion having a forward cutting edge which moves along a substantially circular path when rotated, and the forward cutting edge defines a series of V-shaped teeth therealong. Each V-shaped tooth has a leading cutting edge and a trailing edge which meet at an apex. The leading cutting edge of each tooth is substantially parallel to the direction of axial movement of the saw blade along the length of the sewer line, and the trailing edge of each tooth forms an angle with the direction of axial movement of the blade which is between about 22° and 63°. Furthermore, a notch is defined between each successively-arranged pair of teeth wherein the notch has a depth of between about 0.5 and 1.0 inches as measured from the apex of an adjacent tooth.

18 Claims, 3 Drawing Sheets

ROTATABLE SAW BLADE FOR ROUTING THROUGH A SEWER LINE

BACKGROUND OF THE INVENTION

This invention relates generally to means and methods for cleaning out sewer lines and relates, more particularly, to a rotatable saw blade used for cleaning a sewer line by rotating the blade and routing it through the sewer line.

A saw blade with which this invention is to be compared is commonly referred to as a root saw blade and includes an arcuate-shaped portion having a forward cutting edge which rotates along a circular path when the blade is rotated about an axis of rotation. During use, the saw blade is rotated about its rotation axis and directed cutting edge-first axially through the sewer line along a path which is substantially parallel to the rotation axis of the blade. As the saw blade is rotated and directed through the sewer line in this manner, debris and roots which might be clinging to the interior wall of the sewer line are severed from the interior wall by the rotating cutting edge.

Heretofore, the cutting edges of root saw blades of the prior art wear relatively rapidly during use which, in turn, reduces the useful working life of the prior art saw blades. Such rapid wear is believed to be due, at least in part, to the relatively large amount of heat which is generated as the root saw blade is rotated and directed through a sewer line. Such heat may be generated, for example, from the friction resulting from the contact between the outer surface of the rotating saw blade and the interior wall of the sewer line as the saw blade is directed therethrough. Furthermore, such heat is likely to accumulate in the blade when the blade continuously contacts, and thus rubs against, the interior wall of the sewer line as the saw blade is routed therethrough. In other words, as long as the blade continuously contacts the interior wall of the sewer line during use, there is little, if any, opportunity for the accumulated heat to dissipate from the saw blade.

It would therefore be desirable to provide a rotatable saw blade for cleaning a sewer line which has a longer working life than do root saw blades of the prior art.

Accordingly, it is an object of the present invention to provide a new and improved rotatable saw blade of the afore-described class.

Another object of the present invention is to provide such a saw blade which has a longer working life than do root saw blades of the prior art.

Still another object of the present invention is to provide such a saw blade which is less likely to experience an accumulation of heat during operation than do root saw blades of the prior art.

Yet another object of the present invention is to provide such a saw blade which has an increased capacity to sever debris or roots from the interior wall of a sewer line.

A further object of the present invention is to provide such a saw blade which is capable of being operated at relatively high rotational speeds and relatively high linear speeds yet effectively cut through debris and roots and relatively stiff items, such as polyvinylchloride (PVC) pipe, which might protrude into the interior of the sewer line being cleaned with the saw blade.

A still further object of the present invention is to provide such a saw blade which is uncomplicated in structure, yet effective in operation.

SUMMARY OF THE INVENTION

This invention resides in a rotatable saw blade for routing through a sewer line for the purpose of separating debris or roots from the interior wall of the sewer line.

The rotatable saw blade includes a body having an arcuate portion having a forward cutting edge which moves along a substantially circular path when the blade is rotated about a rotation axis and defines a plurality of V-shaped teeth arranged in succession along the forward cutting edge thereof. The arcuate portion also defines a notch between a pair of successively-arranged teeth wherein the defined notch has a depth of at least about 0.5 inches as measured from the apex of an adjacent tooth.

In one embodiment of the saw blade, each V-shaped tooth has a leading edge and a trailing edge, and the leading edge of each tooth is oriented substantially parallel to the direction of intended movement of the blade axially along the length of the sewer line. Meanwhile, the trailing edge of each tooth forms an angle with respect to the direction of intended movement of the saw blade axially along the length of the sewer line which is no greater than about 63°.

DETAILED DESCRIPTION OF AN ILLUSTRATIVE EMBODIMENT

Figure 1:
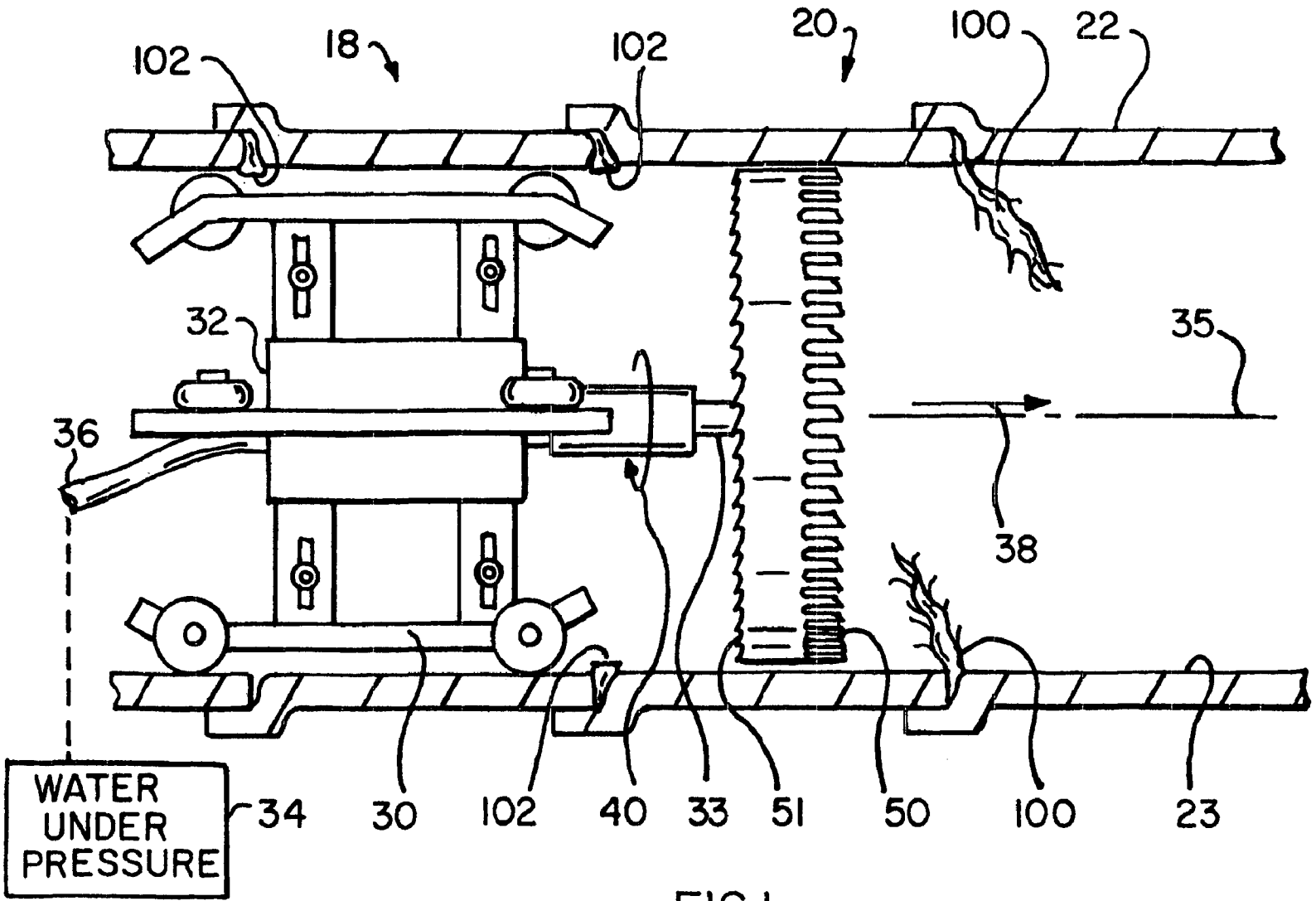
FIG. 1 is a longitudinal cross-sectional view illustrating sewer-cleaning equipment including a saw blade embodying features of the present invention shown positioned within a sewer line desired to be cleaned with the equipment.

Turning now to the drawings in greater detail and considering first FIG. 1, there is illustrated an embodiment, generally indicated 20, of a rotatable root saw blade shown positioned within a sewer line 22 for purposes of cleaning out the interior of the sewer line 22. The depicted saw blade 20 is shown in conjunction with other components of sewer-cleaning equipment, generally indicated 18, to which the blade 20 is attached and with which the blade 20 is both rotated about a rotation axis and guided axially through the sewer line 22 as the blade 20 is used to sever and thereby separate items, such as debris and roots, from the interior wall, indicated 23, of the sewer line 22. As will be apparent herein, the saw blade 20 is configured to effectively sever items from the interior wall 23 of the sewer line 22 at a relatively high rate of rotation and at a relatively high speed of movement axially through the sewer line 22 while reducing the likelihood that appreciable heat will build up within the saw blade 20 during use.

With reference still to FIG. 1, the sewer-cleaning equipment 18 includes a water-powered motor 32 which is mounted upon a wheeled frame 30 and includes a rotatable shaft 33 to which the rotatable blade 20 is connected for rotation therewith. Water, under pressure, is conducted to the water-powered motor 32 from a source 34 by way of a hose 36 for operating the motor 32 and, thus rotating the blade 20 about an axis of rotation, indicated 35, which is substantially coincident with the longitudinal centerline of the sewer line 22.

Furthermore, water which is routed through the motor 32 for rotating the shaft 33 is discharged from the sides of the motor 32 so as to impinge upon the interior wall 23 of the sewer line 22 in a manner which propels the wheeled frame 30 forwardly through the sewer line 22 (i.e. along the direction indicated by the arrow 38). In other words, water which is routed to the motor 32 from the source 34 effects both the rotation of the saw blade 20 (in the rotational direction indicated by the arrow 40) and the forward advancement of the saw blade 20 axially along the length of the sewer line 22. If it is desired to reverse the direction of the wheeled frame 30 to, for example, back the equipment 18 and blade 20 out of the sewer line 22, the pressure of the water delivered to the motor 32 can be reduced to thereby reduce the forwardly-propelling force of the water impinging upon the interior wall 23 of the sewer line 22 so that the equipment 18 can be pulled rearwardly along the sewer line 22 (in opposition to the forwardly-propelling forces acting upon the wheeled frame 30) by pulling rearwardly upon (or winding up) the hose 36.

An example of equipment which is well-suited for use as the equipment 18 is commercially available from Sewer Equipment of America, Glenview, Ill., under the trade designation Patriot, Model WJ-49P. This commercially-available equipment is capable of operating its water-powered motor at pressures up to about 1800 pounds per square inch (psi) so that the motor shaft 33, and thus the saw blade 20 attached thereto, is rotated at rotational speeds as high as about 1200 revolutions per minute (rpms). Using such high water pressures, this equipment is capable of moving forwardly (i.e. axially) through a sewer line 22 at speeds as high as about thirty feet per second (fps).

Figure 2:
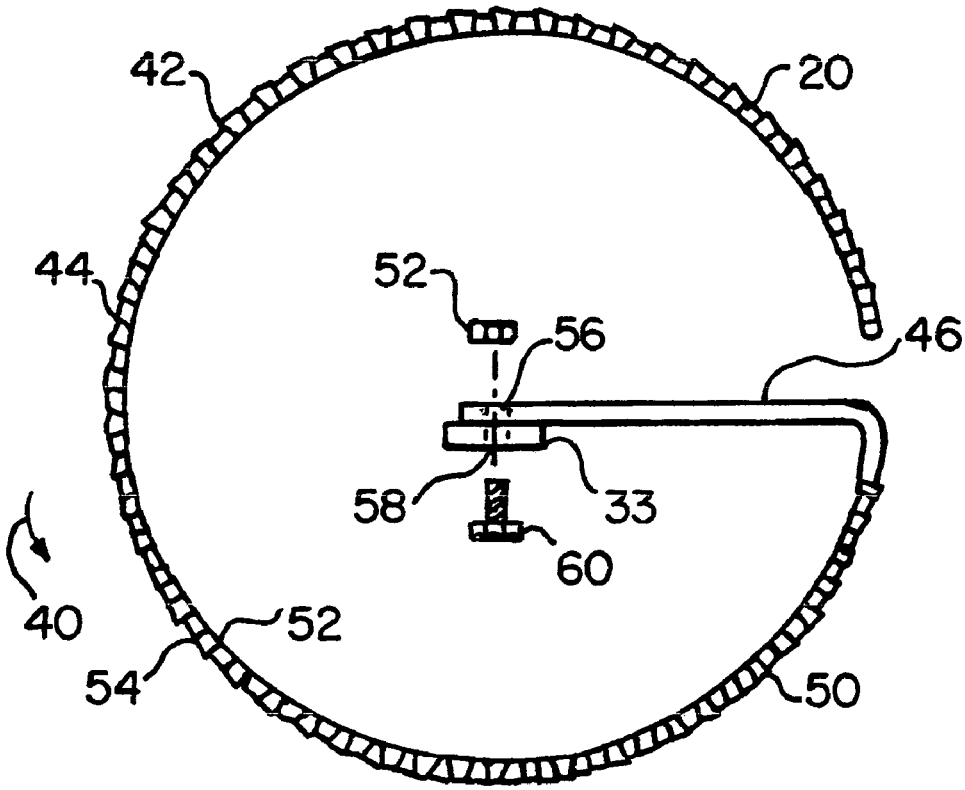
FIG. 2 is a frontal view of the saw blade of FIG. 1 as seen generally from the right in FIG. 1 and a fragment of the equipment to which the blade is attached.
Figure 3:
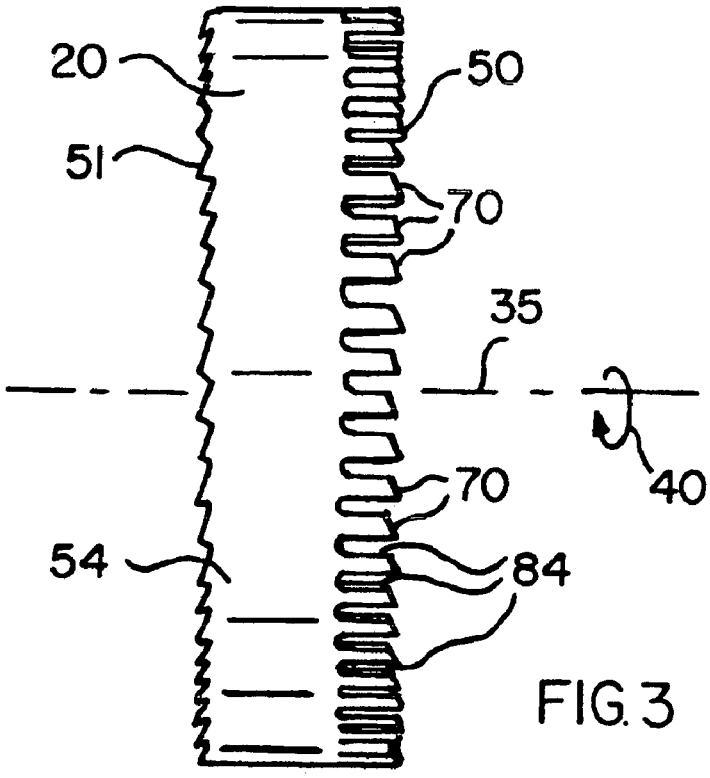
FIG. 3 is a side view of the saw blade of FIG. 1 as seen generally from the left in FIG. 2.

With reference to FIGS. 2 and 3, the saw blade 20 includes a relatively thin body 42 having an arcuate-shaped annular portion 44 having a forward cutting edge 50 and an opposite rearward cutting edge 51 and being of appreciable width (e.g. about 2 inches) as measured between the forward and rearward cutting edges 50 and 51. During use of the blade 20, the forward cutting edge 50 is directed forwardly of the wheeled frame 30 (FIG. 1) and travels in a substantially circular path (in the rotational direction indicated by the arrow 40) as the saw blade 20 is rotated about its rotation axis 35. In addition and as best shown in FIG. 2, the arcuate portion 44 includes inside and outside walls, indicated 52 and 54, respectively, of the arcuate portion 44 wherein the inside wall 52 faces radially inwardly of the arcuate portion 44 and the outside wall 54 faces radially outwardly of the arcuate portion 44.

The body 42 of the blade 44 further includes a substantially linear attachment portion 46 which is integrally joined to the arcuate portion 44 adjacent the circumferential periphery of the blade 44 and extends radially inwardly thereof through about the geometric center of the arcuate portion 44. The attachment portion 46 has a width which is substantially equal to the width of the arcuate portion 44 as measured between the forward and rearward cutting edges 50 and 51.

Furthermore, the arcuate portion 46 includes a through-opening 56 (FIG. 2) disposed at about the geometric center of the arcuate portion 44 and which opens in a direction which is substantially perpendicular to the rotation axis 35 of the blade 20, and this through-opening 56 is used to join the saw blade 20 to the shaft 33 of the water-powered motor 32. To this end and as best shown in FIG. 2, the shaft 33 has an end through which a transversely-extending through-opening 58 is defined, and the saw blade 20 is positionable in such a relationship with the shaft 33 so that the through-opening 56 of the attachment portion 46 is aligned with the through-opening 58 of the shaft 33. The shank of a bolt 60 can then be directed through the aligned through-openings 56 and 58, and a nut 62 can be threadably secured about the shank of the bolt 60 to thereby secure the saw blade 20 to the motor shaft 33. With the saw blade 20 secured to the end of the shaft 33 in this manner, the rotation of the motor shaft 33 effects the rotation of the saw blade 20 about the rotation axis 35.

Figure 4:
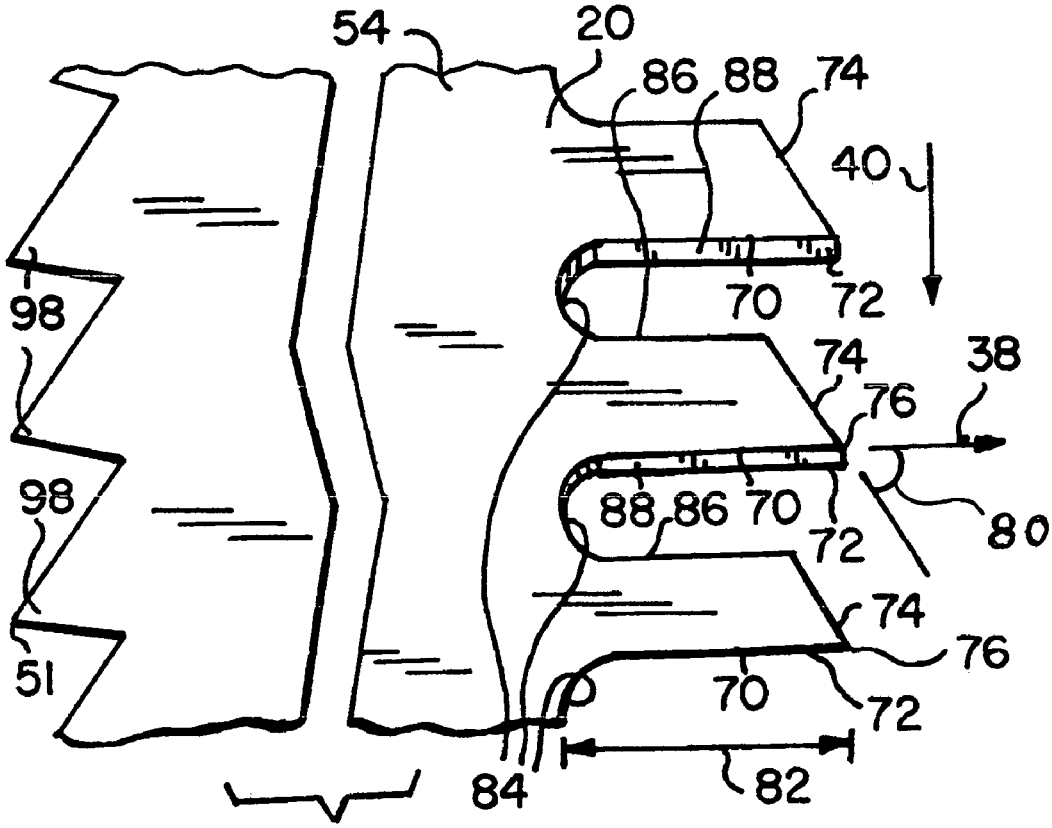
FIG. 4 is a view of a fragment of the saw blade as seen in the FIG. 3 view, but drawn to a slightly larger scale.

With reference to FIGS. 2-4, the body 42 of the saw blade 20 defines a series, or plurality, of cutting teeth 70 arranged in succession (i.e. one-after-the-other) along the length of the forward cutting edge 50. Each tooth 70 of the series of teeth 70 is V-shaped in form (adjacent the tip thereof) having a substantially linear leading cutting edge 72 and a substantially linear trailing edge 74 which meet at an apex 76. The leading cutting edge 72 is referred to herein as the "leading cutting edge" in the sense that it is the edge of the tooth 70 which first engages an item (e.g. debris or roots) as the saw blade 20 is rotated about its rotation axis 35 (i.e. in the rotational direction indicated by the arrow 40) and advanced forwardly along the length of the sewer line 22 (i.e. in the linear direction indicated by the arrow 38), and the trailing edge 74 is referred to herein as the "trailing cutting edge" in the sense that it is the edge of the tooth 70 which trails the leading cutting edge 72 as the saw blade 20 is rotated about its rotation axis 35.

It is a feature of the saw blade 20 that the leading cutting edge 72 is oriented substantially parallel to the direction of intended forward movement of the blade 20 along the sewer line 22 (which direction is indicated by the arrow 38) or, in other words, substantially parallel to the longitudinal centerline (e.g. the rotation axis 35) of the saw blade 20. Furthermore, the trailing cutting edge 72 of each tooth 70 of the blade 20 forms an angle 80 (FIG. 4) with the direction of intended movement of the blade 20 along the sewer line 22 which is within the range of between about 22° and 63°, and is preferably about 25°. By providing the trailing cutting edges 74 of the teeth 70 (whose wear during use commonly begins to appear at the apexes 76 thereof) with angles 80 of between 22° and 63°, the teeth 70 maintain an acceptable degree of sharpness for a considerable period of use.

It is also a feature of the blade 20 that its body 42 defines a relatively deep notch 84 between each successive pair of teeth 70 provided along the cutting edge of the blade 20. Each notch 84 has a depth, indicated 82 in FIG. 4, as measured from the apex 76 of an adjacent tooth 70 which is between about 0.5 inches and 1.0 inches, and each notch 84 has a width (as measured between the trailing edge 74 of one tooth 70 and the leading cutting edge 72 of the following tooth 70 in sequence) which is about 5/32 of an inch. The breadth of each notch 84 substantially corresponds with the thickness of the arcuate portion 44 of the body 42 which, in the depicted blade 20, is about 5/32 of an inch. Inasmuch as a saw blade 20 is likely to increase in temperature as the blade 20 is rotated about its rotation axis 35 and moved axially along the sewer line 22 in cutting relationship with items (e.g. debris or roots), the notches 84 provided in the body of the blade 20 help to prevent the accumulation of excessive heat in the blade 20 during use and thereby increase the useful working life of the blade 20. The capacity of the notches 84 to help the blade 20 operate at cooler temperatures is believed to be due, at least in part, to the ability of the teeth 70 to better act as fins from which heat is radiated during use of the blade 20 and to promote the passage of air between successive teeth 70 during the rotation of the blade 20.

With reference to FIG. 4, each notch 84 has a pair of opposing planar sidewalls 86, 88 which are substantially parallel to one another, and one sidewall 88 is contiguous with (i.e. coplanar with) the leading cutting edge 72 of the following tooth 70. Furthermore and as best shown in FIG. 5, each of the opposing sidewalls 86, 88 are sloped with respect to a cross-sectional plane taken through the blade 20 and which contains the rotational axis 35 (FIGS. 3 and 4) of the blade 20.

Figure 5:
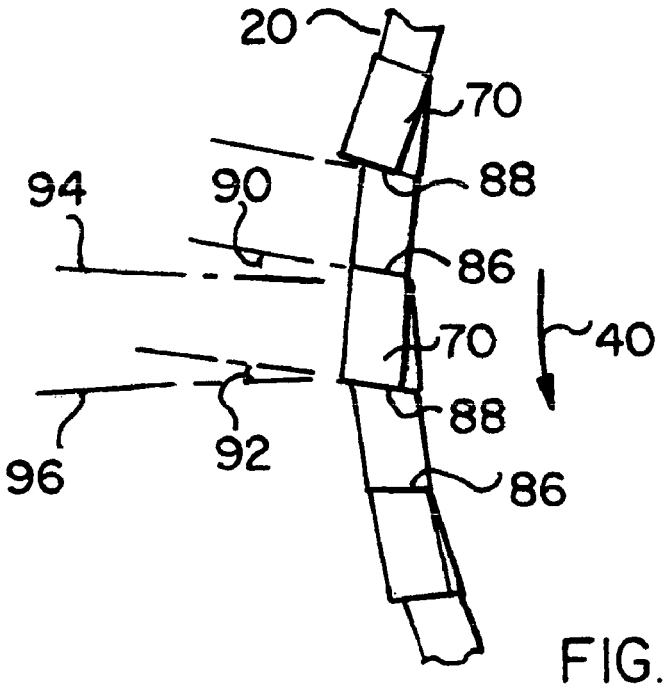
FIG. 5 is a frontal view of the FIG. 4 fragment, as seen generally from the right in FIG. 4.

More specifically and with reference to FIG. 5, each notch sidewall 86 forms an angle 90 with a cross-sectional plane 94 taken through the blade 20 and which contains the rotational axis 35 wherein the angle 90 is between about 10° and 14° (and preferably about 12°) while each notch sidewall 88 forms an angle 92 with a cross-sectional plane 96 taken through the blade 20 and which contains the rotational axis 35 wherein the angle 92 is between about 10° and 14° (and preferably about 12°).

With reference again to FIG. 4, the arcuate portion 44 of the blade 20 also includes a series of saw blade teeth 98 which are defined along the rearward cutting edge 51 of the blade 20 to facilitate the movement of the blade 20 rearwardly along the sewer line 22. These cutting teeth 98 are helpful in the event that it becomes necessary for the motor 32 and blade 20 to be reversed in axial direction along the length of the sewer line 22. In other words, these teeth 98 help the blade 20 to cut through items disposed behind the blade 20 to thereby aid the movement of the motor 32 and blade 20 in a rearward direction along the sewer line 22. It will be understood, however, that whether the motor 32 and blade 20 are advanced forwardly along the length of the sewer line 22 or moved rearwardly along the length of the sewer line 22, the direction of rotation of the saw blade 20 about the rotation axis 35 is the same (i.e. corresponding with the direction of the FIG. 1 arrow 40).

The saw blade 20 can be constructed out of 1040 spring steel which has been heat treated to a Rockwell 50-55 hardness.

It has been found that the aforedescribed saw blade 20 can be rotated with the aforedescribed sewer-cleaning equipment 18 at speeds up to about 1200 rpm and directed forwardly through a sewer line 22 (under the influence of the water-propelling jets emitted from the motor 32) at a linear speeds of about 30 feet per second for purposes of cleaning out a sewer line 22 and yet experience relatively small wear along the forward cutting edge 50. In this connection, there are illustrated in FIG. 1 a plurality of roots 100 which are growing into the interior of the sewer line 22 from the interior wall 23 thereof and which are positioned in advance of the saw blade 20. For comparison purposes, there is also illustrated in FIG. 1 a few root stumps 102 over which the saw blade 20 has already passed. The root stumps 102 have been cut smoothly at the surface of the interior wall 23 of the sewer line 22. If it is desired to slow down the water-propelled advancement of the motor 32 and blade 20 through a sewer line 22 for the purpose, for example, of achieving cleaner cuts of heavy debris and roots adjacent the surface of the interior wall 23, the feeding of the hose 26 (which joined to the water-powered motor 32 of the equipment 18) into the sewer line 22 behind the motor 32 and blade 20 can be slowed down to a controlled, or slower, rate. Further still, the blade 20 has been found capable of cutting through polyvinylchloride (PVC) pipe (i.e. Schedule 40 PVC) which might protrude into the sewer line 22 from an interior wall thereof.

The relatively slow rate of wear of the saw blade 22 during use is in marked contrast to the root saw blades of the prior art which, if operated under comparable circumstances (i.e. comparable rotational speeds and linear speeds through a sewer line) have been found to completely wear out, and thus be rendered unusable, within about 200 linear feet of use. As mentioned earlier, such rapid wear is believed to be due, at least in part, to the accumulation of heat in the prior art blades as the blade rubs against the interior wall 23 of the sewer line 22 during use. By comparison, the blade 20, complete with its notches 84 formed between each pair of successively-arranged teeth 70 disposed along the forward cutting edge 50, the aforedescribed slope of the opposing sidewalls 86, 88 of the notches 84, and the aforedescribed relationship of the leading and trailing edges of each teeth 70 in relation to the direction, or path, of intended linear movement of the blade 20 through the sewer line 22 has been found not to wear out until after about one mile of linear feet of use.

It follows from the foregoing that a rotatable saw blade 20 has been described which has an arcuate portion 44 having a forward cutting edge 50 which moves along a substantially circular path when the blade 20 is rotated about a rotation axis 35. The arcuate portion 44 defines a plurality of V-shaped teeth 70 arranged in succession along the forward cutting edge 50 and further defines a notch 84 between each pair of successively-arranged teeth wherein the notch has a depth as measured from the apex of an adjacent tooth which is at least about 0.5 inches.

It will be understood that numerous modifications and substitutions can be had to the aforedescribed embodiment without departing from the spirit of the invention. For example, although the arcuate portion 44 of the aforedescribed embodiment 20 can possess a diameter which is about 9.5 inches and a thickness of about 5/32 inches as measured between its inside and outside walls 52, 54 and thus suitable for cleaning out a ten-inch sewer line, saw blades embodying features of the present invention can possess arcuate portions having alternatively-sized diameters and thicknesses for cleaning out sewer lines of alternative sizes. Accordingly, the aforedescribed embodiment 20 is intended for the purpose of illustration and not as limitation.

The invention claimed is:

1. A rotatable saw blade for routing through a sewer line wherein the saw blade is rotated in only one rotational direction about a rotation axis during use for the purpose of separating debris or roots from the interior wall of the sewer line, the rotatable saw blade comprising:

a rotatable body having an arcuate portion having a forward cutting edge which moves along a substantially circular path when the blade is rotated about the rotation axis and wherein the circular path of movement of the forward cutting edge is oriented in a plane which is substantially perpendicular to the rotation axis of the blade and so that the path of movement of the forward cutting edge through any roots or debris being separated from the interior wall of a sewer line through which the saw blade is routed is necessarily arcuate;

the arcuate portion of the body defining a plurality of V-shaped teeth arranged in succession along the forward cutting edge thereof wherein each V-shaped tooth has a leading edge portion and a trailing edge portion which meet at an apex and wherein the leading edge portion of each tooth is substantially parallel to the direction of intended movement of the blade along the length of the sewer line so that the leading edge portion forms an angle of zero degrees with the direction of intended movement of the blade along the length of the sewer line and the trailing edge portion of each tooth forms an angle with respect to the direction of intended movement of the saw blade along the length of the sewer line which is between about twenty-two and sixty-three degrees; and the arcuate portion further defines a notch between a pair of successively-arranged teeth wherein the notch has a depth of at least about 0.5 inches as measured from the apex of an adjacent tooth.

2. The saw blade as defined in claim 1 wherein each defined notch opens forwardly of the forward cutting edge and has a pair of sidewalls which oppose one another.

3. The saw blade as defined in claim 2 wherein the sidewalls of each notch are parallel to one another.

4. The saw blade as defined in claim 3 wherein the opposing sidewalls of each notch are sloped at an angle of between about ten and fourteen degrees with respect to a cross-sectional plane taken through the blade and which contains the rotation axis of the blade.

5. The saw blade as defined in claim 1 wherein each defined notch opens forwardly of the forward cutting edge and has sidewalls which oppose one another, and the leading edge portion of each tooth is contiguous with a sidewall of a notch which precedes the tooth.

6. The saw blade as defined in claim 5 wherein the opposing sidewalls of each notch are parallel to one another and each of the opposing sidewalls forms an angle of between about ten and fourteen degrees with respect to a cross-sectional plane taken through the blade and which contains the rotation axis of the blade.

7. The saw blade as defined in claim 1 wherein the body further includes an attachment portion which is joined to so as to extend radially inwardly of the arcuate portion for attachment of the saw blade to rotary drive means.

8. A rotatable saw blade for routing through a sewer line for purposes of cleaning the sewer line wherein the saw blade is rotated in only one direction about a rotation axis during use, the saw blade comprising:

a body having an attachment portion to which a rotary drive can be coupled for rotation of the saw blade about the rotation axis and an arcuate portion having a forward cutting edge which moves along a substantially circular path when the saw blade is rotated about the rotation axis and wherein the circular path of movement of the forward cutting edge is oriented in a plane which is substantially perpendicular to the rotation axis of the blade and so that the path of movement of the forward cutting edge through any objects present within the sewer line through which the saw blade is routed is necessarily arcuate and wherein there is defined along the forward cutting edge a plurality of V-shaped teeth arranged in succession along the forward cutting edge wherein each V-shaped tooth has a leading edge portion and a trailing edge portion of each tooth which meet at an apex and wherein the leading edge portion of each tooth is substantially parallel to the direction of intended movement of the blade along the length of the sewer line so that the leading edge portion forms an angle of zero degrees with the direction of intended movement of the blade along the length of the sewer line and the trailing edge portion of each tooth forms an angle with respect to the direction of intended movement of the saw blade along the length of the sewer line which is between about twenty-two and sixty-three degrees; and wherein the arcuate portion of the body defines a notch between pairs of successively-arranged teeth and each defined notch has a depth of at least about 0.5 inches as measured from the apex of an adjacent tooth.

9. The saw blade as defined in claim 8 wherein each defined notch opens forwardly of the forward cutting edge and has a pair of sidewalls which oppose one another.

10. The saw blade as defined in claim 9 wherein the sidewalls of each notch are parallel to one another.

11. The saw blade as defined in claim 10 wherein the opposing sidewalls of each notch are sloped at an angle of between about ten and fourteen degrees with respect to a cross-sectional plane taken through the blade and which contains the rotation axis of the blade.

12. The saw blade as defined in claim 11 wherein the opposing sidewalls of each notch are sloped at an angle of about twelve degrees with respect to a cross-sectional plane taken through the blade and which contains the rotation axis of the blade.

13. The saw blade as defined in claim 8 wherein each defined notch opens forwardly of the forward cutting edge and has sidewalls which oppose one another, and the leading edge portion of each tooth is contiguous with a sidewall of a notch which precedes the tooth along the forward cutting edge.

14. The saw blade as defined in claim 13 wherein the opposing sidewalls of each notch are parallel to one another and are each sloped at an angle of between about ten and fourteen degrees with respect to a cross-sectional plane taken through the blade and which contains the rotation axis of the blade.

15. The saw blade as defined in claim 8 wherein the arcuate portion has a rearward cutting edge opposite the forward cutting edge.

16. A rotatable saw blade for routing through and cleaning a sewer line wherein the saw blade is rotated in only one rotational direction about a rotation axis during use, said rotatable saw blade comprising:

a body having a relatively thin wall and having an arcuate portion having a forward cutting edge which moves along a substantially circular cutting path when the blade is rotated about the rotation axis and an attachment portion for attachment of the saw blade to rotary drive means and wherein the circular path of movement of the forward cutting edge is oriented in a plane which is substantially perpendicular to the rotation axis of the blade and so that the path of movement of the forward cutting edge through any objects present within the sewer line through which the saw blade is routed is necessarily arcuate;

the arcuate portion defining a series of V-shaped teeth arranged in succession along the forward cutting edge wherein each V-shaped tooth in the series has a leading edge portion and a trailing edge portion which meet at an apex;

the leading edge portion of each tooth is substantially parallel to the direction of intended movement of the blade axially along the length of the sewer line so that the leading edge portion forms an angle of zero degrees with the direction of intended movement of the blade along the length of the sewer line; and the trailing edge portion of each tooth forms an angle with respect to the direction of intended movement of the saw blade axially along the length of the sewer line which is between about twenty-two and sixty-three degrees; and the arcuate portion further defines a notch between each pair of successively-arranged teeth wherein each notch has a depth as measured from the apex of an adjacent tooth which is between about 0.5 and 1.0 inches.

17. The saw blade as defined in claim 16 wherein the opposing sidewalls of each notch are parallel to one another and are each sloped at an angle of between about ten and fourteen degrees with respect to a cross-sectional plane taken through the blade and which contains the rotation axis of the blade.

18. The saw blade as defined in claim 16 wherein the arcuate portion has a rearward cutting edge opposite the forward cutting edge.

* * * * *